US009174332B2

(12) United States Patent
Burke et al.

(10) Patent No.: US 9,174,332 B2
(45) Date of Patent: Nov. 3, 2015

(54) FASTENING TOOL HAVING AN INTERCHANGEABLE POWER SOURCE

(71) Applicant: Stanley Fastening Systems, L.P., North Kingstown, RI (US)

(72) Inventors: Brian C. Burke, Barrington, RI (US); Jonathan Kalow, East Greenwich, RI (US)

(73) Assignee: STANLEY FASTENING SYSTEMS, L.P., North Kingstown, RI (US)

( * ) Notice: Subject to any disclaimer, the term of this patent is extended or adjusted under 35 U.S.C. 154(b) by 474 days.

(21) Appl. No.: 13/724,468

(22) Filed: Dec. 21, 2012

(65) Prior Publication Data

US 2013/0175313 A1 Jul. 11, 2013

Related U.S. Application Data

(60) Provisional application No. 61/583,910, filed on Jan. 6, 2012.

(51) Int. Cl.
*B25C 1/04* (2006.01)

(52) U.S. Cl.
CPC ..... *B25C 1/04* (2013.01)

(58) Field of Classification Search
CPC ..... B25B 21/02; B25B 23/14; B25B 23/145; B25C 1/047
USPC ..... 227/8, 130, 142, 140; 137/505.11
See application file for complete search history.

(56) References Cited

U.S. PATENT DOCUMENTS

| | | | | |
|---|---|---|---|---|
| 4,211,352 | A | 7/1980 | Zilka | |
| 6,220,496 | B1 | 4/2001 | Hirai et al. | |
| 6,572,000 | B2 | 6/2003 | Hirai et al. | |
| 6,796,387 | B1 | 9/2004 | Lund et al. | |
| 7,063,247 | B1 | 6/2006 | Lund et al. | |
| 7,168,603 | B1 * | 1/2007 | Lund et al. | 227/10 |
| 7,225,959 | B2 | 6/2007 | Patton et al. | |
| 7,494,035 | B2 | 2/2009 | Weaver et al. | |
| 7,565,911 | B2 * | 7/2009 | Bonta, Jr. | 137/14 |
| 2003/0173098 | A1 | 9/2003 | Miner et al. | |
| 2004/0182909 | A1 * | 9/2004 | Lund et al. | 227/130 |
| 2005/0252944 | A1 * | 11/2005 | Patrick | 227/8 |
| 2006/0102365 | A1 | 5/2006 | Phillips et al. | |
| 2007/0068988 | A1 | 3/2007 | Atcheson | |
| 2008/0283569 | A1 * | 11/2008 | Kral | 227/130 |
| 2010/0200260 | A1 | 8/2010 | Mikami et al. | |

FOREIGN PATENT DOCUMENTS

EP 2116332 A1 11/2009

* cited by examiner

*Primary Examiner* — Nathaniel Chukwurah
(74) *Attorney, Agent, or Firm* — Harness, Dickey & Pierce, P.L.C.

(57) ABSTRACT

A driving tool with tool portion and a gas delivery system. The tool portion includes a linear pneumatic motor that is configured to propel a driver blade. The gas delivery system is configured to deliver a pressurized gas, such as compressed air or nitrogen, to the tool portion for use in operating the linear pneumatic motor. The gas delivery system includes a first inlet, which is connectable to a first source of compressed gas, such as a stationary air compressor, a second inlet, which is connectable to a second source of compressed gas, such as a tank mounted to the tool portion, and a directional valve for selecting between the first and second inlets.

13 Claims, 3 Drawing Sheets

FASTENING TOOL HAVING AN INTERCHANGEABLE POWER SOURCE

CROSS-REFERENCE TO RELATED APPLICATIONS

This application claims the benefit of U.S. Provisional Application No. 61/583,910, filed on Jan. 6, 2012, the disclosure of which is incorporated herein by reference as if fully set forth in detail herein.

FIELD

The present disclosure relates to a driving tool having an interchangeable power source.

BACKGROUND

This section provides background information related to the present disclosure which is not necessarily prior art.

U.S. Patent Application Publication No. 2008/0283569 discloses an expulsion device actuated by a pressure medium. The expulsion device is configured to expel objects or liquid materials from a reservoir by means of a drive piston which is impinged upon by a pressure medium. The pressure medium can be received from a stationary pressure source, or a pressure medium container. While such device is suited for its intended purpose, it is nonetheless susceptible to improvement.

SUMMARY

This section provides a general summary of the disclosure, and is not a comprehensive disclosure of its full scope or all of its features.

In one form, the present teachings provide a driving tool having a housing, a pneumatic linear motor, a driver blade, a first inlet, a second inlet, a directional valve, a pressure limiting device, a shut-off valve and a regulator. The housing has a handle and a pressure chamber. The pneumatic linear motor is housed in the housing and has an output member. The pneumatic linear motor is in fluid communication with the pressure chamber. The driver blade disposed in the housing and is coupled to the output member for movement therewith along a driver axis. The first inlet is configured to be coupled to a first source of compressed gas. The second inlet is configured to be coupled to a second source of compressed gas. The directional valve is in fluid communication with the pressure chamber and is selectively operable in first and second conditions. Operation of the directional valve in the first condition establishes a first flow path in which the first inlet is coupled in fluid communication to the pressure chamber and fluid communication between the pressure chamber and the second inlet is inhibited. Operation of the directional valve in the second condition establishes a second flow path in which the second inlet is coupled in fluid communication to the pressure chamber and fluid communication between the pressure chamber and the first inlet is inhibited. The pressure limiting device is disposed between the second inlet and the directional valve. The shut-off valve is disposed between the pressure limiting device and the directional valve. The regulator is disposed in fluid communication between the shut-off valve and the directional valve.

In another form, the present teachings provide a driving tool that has a housing, a pneumatic linear motor, a driver blade, a magazine and a gas feed system. The housing has a handle and a pressure chamber. The pneumatic linear motor is housed in the housing and has an output member. The pneumatic linear motor is in fluid communication with the pressure chamber. The driver blade is disposed in the housing and is coupled to the output member for movement therewith along a driver axis. The magazine is coupled to the housing and is configured to hold a plurality of fasteners and sequentially feed the fasteners into a position where they can be engaged by the driver blade to be driven into a workpiece. The gas feed system includes a directional valve, a tank, a pressure limiting device, a shut-off valve and a regulator. The directional valve has a first inlet, a second inlet and an outlet. The outlet is coupled in fluid communication with the pressure chamber. The first inlet is configured to be coupled in fluid communication to a first source of compressed gas. The tank is coupled to the housing and is coupled in fluid communication with the second inlet. The tank is configured for use as a second source of compressed gas. The pressure limiting device is disposed between the second inlet and the directional valve. The shut-off valve is disposed between the pressure limiting device and the directional valve. The regulator is disposed in fluid communication between the shut-off valve and the directional valve.

In a further form, the present teachings provide a method for operating a driving tool that has a housing, a pneumatic linear motor, a driver blade and a gas feed system. The housing has a pressure chamber. The pneumatic linear motor is housed in the housing and is coupled in fluid communication with the pressure chamber. The pneumatic linear motor has an output member to which the driver blade is coupled for movement therewith along a driver axis. The gas feed system includes a directional valve, a pressure limiting device, a shut-off valve and a regulator. The directional valve has a first inlet, a second inlet and an outlet. The outlet is coupled in fluid communication with the pressure chamber. The pressure limiting device is disposed between the second inlet and the directional valve. The shut-off valve is disposed between the pressure limiting device and the directional valve. The regulator is disposed in fluid communication between the shut-off valve and the directional valve. The method includes: coupling the first inlet to a first source of compressed gas; coupling a gas tank to the second inlet, the gas tank being a second source of compressed gas; securing the gas tank to the housing; operating the directional valve in a first condition to direct compressed gas from the first source of compressed gas to the pressure chamber; operating the directional valve in a second condition to direct compressed gas from the gas tank to the pressure chamber; and adjusting the regulator to change the pressure of the gas entering the pressure chamber when the directional valve is in the second condition.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
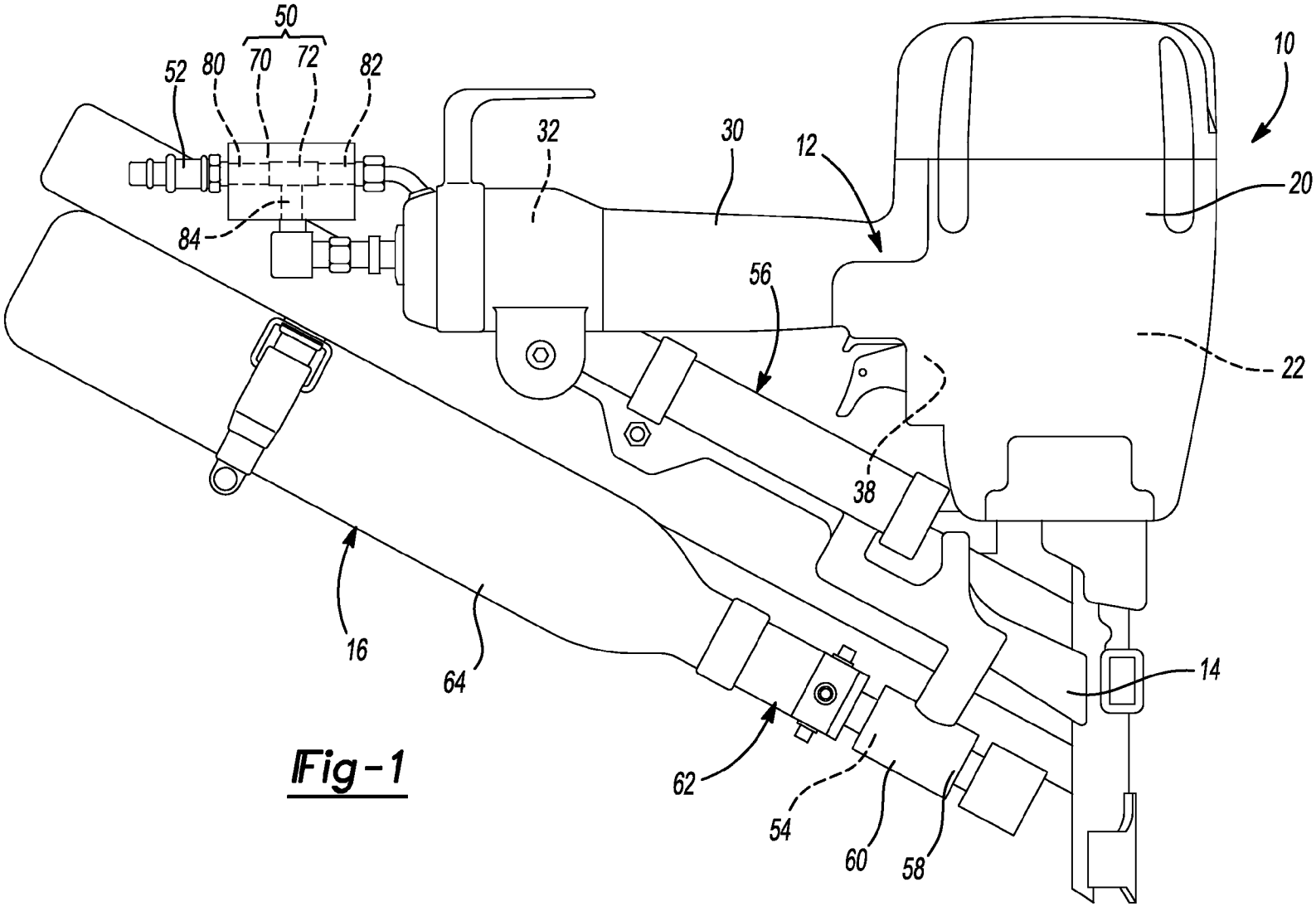
FIG. 1 is a right side elevation view of an exemplary driving tool constructed in accordance with the teachings of the present disclosure.

With reference to FIG. 1 of the drawings, a driving tool constructed in accordance with the teachings of the present invention is generally indicated by reference numeral 10. The driving tool 10 can include tool portion 12, a magazine 14 and a gas delivery system 16. Except as noted herein, the tool portion 12 and the magazine 14 can be generally conventional in their construction and operation. For example, the tool portion 12 and the magazine 14 can be constructed as is described in U.S. Pat. No. 6,609,646, the disclosure of which is incorporated by reference as if fully set forth in detail herein.

Figure 2:
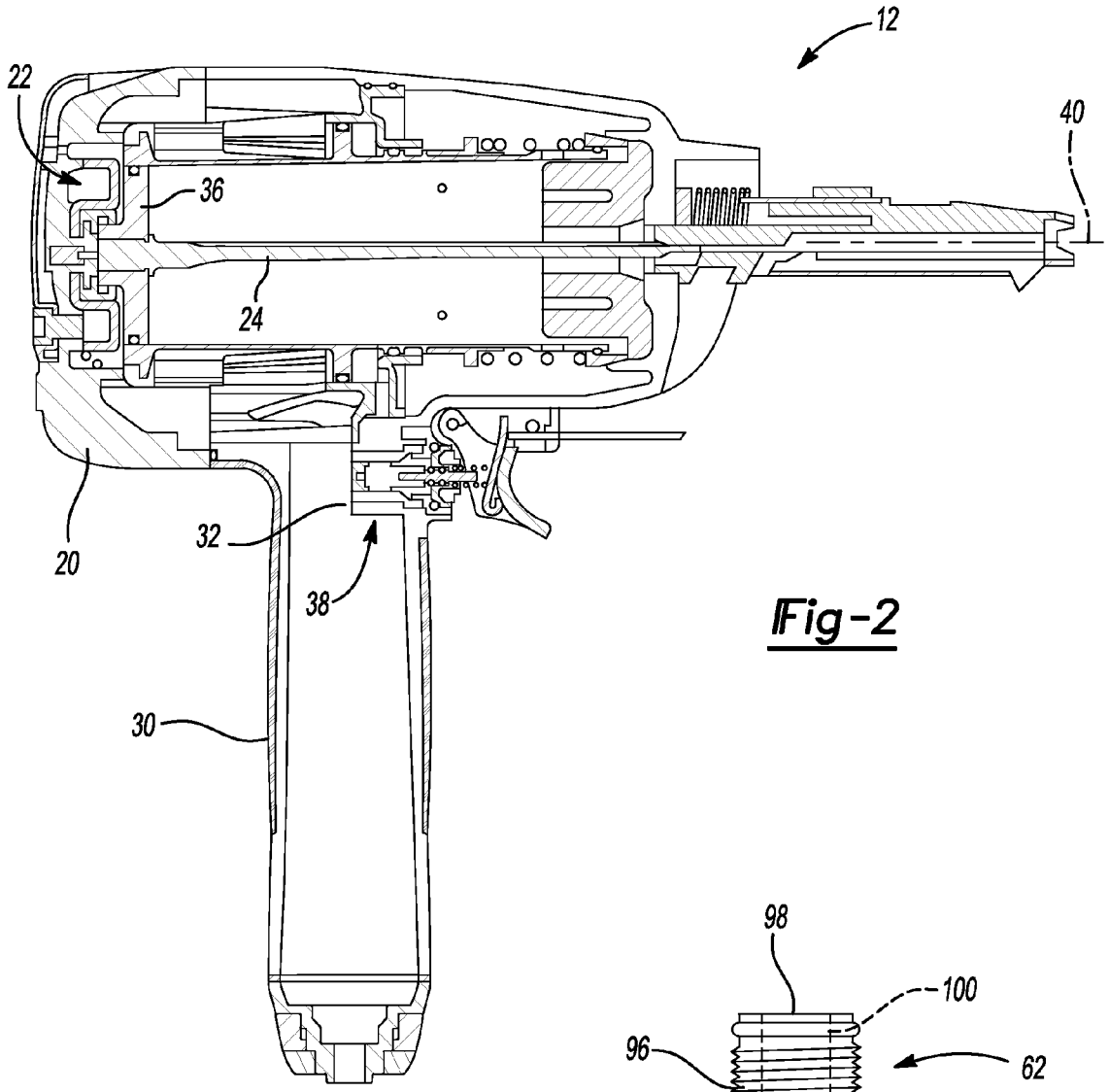
FIG. 2 is a longitudinal section view of a portion of the driving tool of FIG. 1 illustrating a tool portion in more detail.

Briefly, and with additional reference to FIG. 2, the tool portion 12 can include a housing 20, a pneumatic linear motor 22, and a driver blade 24. The housing 20 can define a handle 30 and a pressure chamber 32 that holds compressed gas that is to be delivered to the pneumatic linear motor 22 for its operation. The pneumatic linear motor 22 can include an output member 36 (e.g., a piston in the particular example provided) and can be in fluid communication with the pressure chamber 32 (i.e., the pneumatic linear motor 22 is configured to receive compressed gas from the pressure chamber 32). In the particular example provided, a trigger valve 38 is disposed between the pressure chamber 32 and an inlet of the pneumatic linear motor 22 to thereby permit a user of the driving tool 10 to control operation of the pneumatic linear motor 22 through operation of the trigger valve 38. Thus, while the trigger valve 38 can interrupt the supply of compressed gas to the inlet of the pneumatic linear motor 22, the pneumatic linear motor 22 is nevertheless configured to receive compressed gas from the pressure chamber 32. The driver blade 24 is disposed in the housing 20 and is coupled to the output member 36 for movement therewith along a driver axis 40. The magazine 14 is coupled to the housing 20 and is configured to hold a plurality of fasteners (not shown), such as staples, nails, or brads. The magazine 14 is further configured to sequentially feed the fasteners into a position (in the housing 20) where the fasteners can be engaged by the driver blade 24 to be driven into a workpiece (not shown).

Figure 3:
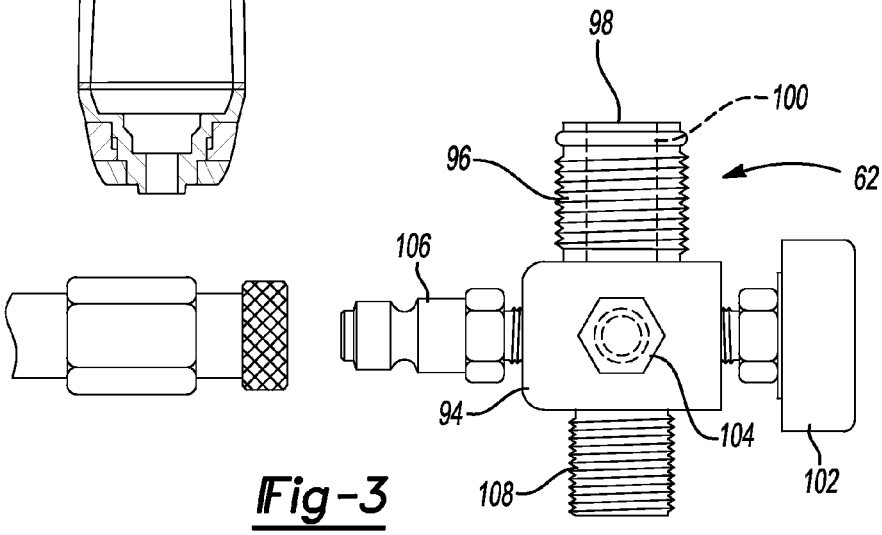
FIG. 3 is an enlarged view of a portion of the pneumatic circuit of FIG. 4.
Figure 4:
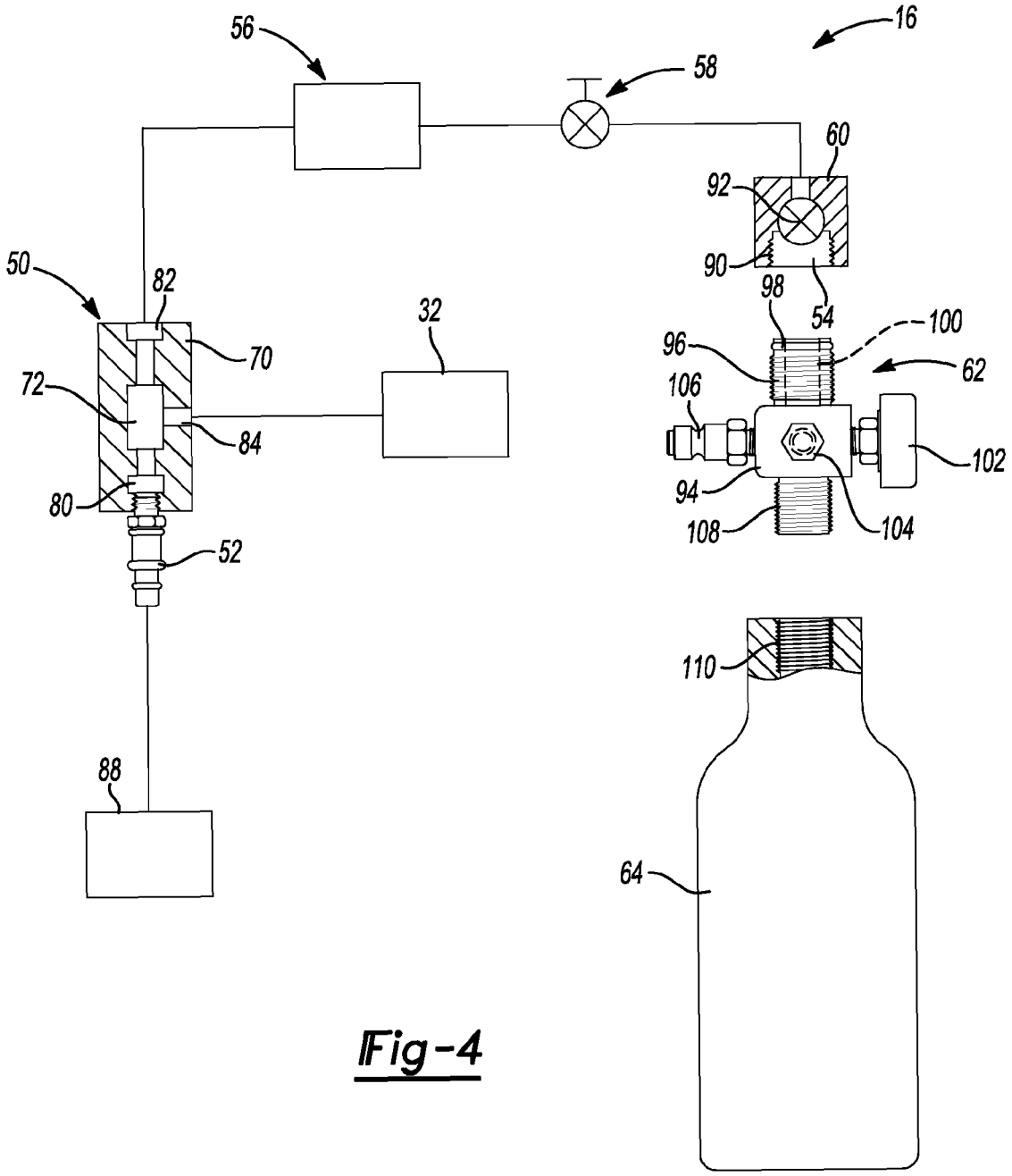
FIG. 4 is a schematic illustration of a pneumatic circuit of the driving tool of FIG. 1.

With reference to FIGS. 1, 3 and 4, the gas delivery system 16 can comprise a directional valve 50, a first inlet 52, a second inlet 54, a regulator 56, a shut-off valve 58, a connector 60, an initial regulation unit 62 and a tank 64. The directional valve 50 can have a valve body 70 and a valve element 72. The valve body 70 can have a first port 80, a second port 82 and an outlet 84. The first port 80 can be or be coupled to the first inlet 52. The second port 82 can be coupled in fluid communication to an outlet side of the regulator 56. The outlet 84 can be coupled in fluid communication with the pressure chamber 32. The valve element 72 can be movable in the valve body 70 between a first element position, which couples the first inlet 52 to the outlet 84 in fluid communication and inhibits fluid communication between the second inlet 54 and the outlet 84, and a second element position that couples the second inlet 54 to the outlet 84 in fluid communication and inhibits fluid communication between the first inlet 52 and the outlet 84. The valve element 72 can be moved through a manual (user) input or through any desired electronic or pneumatic control means. In the particular example provided, the directional valve 50 is a shuttle valve and the valve element 72 is moved in the valve body 70 based on the pressure of the gas that acts on the opposite sides of the valve element 72.

The first inlet 52 is configured to be coupled in fluid communication to a first source of compressed gas, such as a stationary air compressor 88.

The regulator 56 can be coupled in fluid communication with the shut-off valve 58. The shut-off valve 58 can be coupled in fluid communication to the connector 60. The connector 60 can comprise any means for coupling the regulator 56 in fluid communication with the initial regulation unit 62, such as a type of commercially-available quick connect fitting (not shown). In the particular example provided, the connector 60 comprises a set of internal threads 90 and a first valve element 92, while the initial regulation unit 62 comprises a unit body 94 with a first set of male threads 96 and a second valve element 98; the first set of male threads 96 can be threaded into the set of internal threads 90 to mechanically couple the initial regulation unit 62 to the connector 60 as well as to cause engagement of the first and second valve elements 92 and 98, which opens a valve 100 housed in the unit body 94 to permit gas to flow through the initial regulation unit 62 and into the connector 60. The valve 100 can also be configured to limit the pressure of the gas that is input to the connector 60 to a predetermined maximum working pressure. In this regard, it will be understood that the valve 100 can be a pressure limiting device.

The initial regulation unit 62 further comprises a pressure gauge 102, a pressure relief means 104 and a fill connection 106, while the unit body 94 further comprises a second set of male threads 108 that are threadably (and sealingly) coupled to mating threads 110 formed in the tank 64. The pressure gauge 102 is configured to measure the gauge pressure of gas in the tank 64. The pressure relief means 104 can be any suitable device for limiting the gas pressure in the tank 64 to a predefined maximum pressure. In the particular example provided, the pressure relief means 104 comprises a burst disk that ruptures in the event of an over-pressure situation to permit gas in the tank 64 to be expelled from the unit body 94. The fill connection 106 can permit the tank 64 to be refilled with compressed gas without a need for decoupling the tank 64 and the initial regulation unit 62 from the remainder of the driving tool 10. In the example provided, the fill connection 106 comprises a high-pressure male quick-connect. The initial regulation unit 62 and the tank 64 are of the type that are commonly used in HPA (High Pressure Air) and N2 (nitrogen) systems for paintball and are commercially available from various sources.

While the gas delivery system 16 has been described as including an initial regulation unit 62 having a valve 100 that can be configured to limit the pressure of air entering the connector 60 to a predetermined maximum working pressure, it will be appreciated that the valve 100 could be configured as solely a shut-off valve (e.g., actuated by contact between the first and second valve elements 92 and 98) and that a second regulator (not shown) could be disposed between the connector 60 and the regulator 56. In such an embodiment, the shut-off valve 58 may be omitted or may be positioned as desired, such as disposed between the regulator 56 and the second regulator or disposed between the connector 60 and the second regulator.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A driving tool comprising:

a housing having a handle and a pressure chamber;

a pneumatic linear motor housed in the housing and having an output member, the pneumatic linear motor being configured to receive compressed gas from the pressure chamber;

a driver blade disposed in the housing and coupled to the output member for movement therewith along a driver axis;

a first inlet that is adapted to be coupled to a first source of compressed gas;

a second inlet that is adapted to be coupled to a second source of compressed gas;

a directional valve in fluid communication with the pressure chamber, the directional valve being selectively operable in first and second conditions, wherein operation of the directional valve in the first condition establishes a first flow path in which the first inlet is coupled in fluid communication to the pressure chamber and fluid communication between the pressure chamber and the second inlet is inhibited, and wherein operation of the directional valve in the second condition establishes a second flow path in which the second inlet is coupled in fluid communication to the pressure chamber and fluid communication between the pressure chamber and the first inlet is inhibited;

a shut-off valve disposed between the second inlet and the directional valve; and a regulator disposed in fluid communication between the shut-off valve and the directional valve.

2. The driving tool of claim 1, wherein the directional valve is configured to automatically select between the first and second flow paths based on a set of pre-defined criteria.

3. The driving tool of claim 2, wherein the set of pre-defined criteria comprises a pressure differential.

4. The driving tool of claim 1, wherein the directional valve is manually operated.

5. The driving tool of claim 1, further comprising a magazine coupled to the housing, the magazine being configured to hold a plurality of fasteners and to sequentially feed the fasteners into a position where they can be engaged by the driver blade to be driven into a workpiece.

6. The driving tool of claim 5, wherein the second source of compressed gas comprises a tank that is mounted to at least one of the housing and the magazine.

7. The driving tool of claim 6, further comprising a clamp that is selectively operable to fix the tank to the housing, the magazine or both the housing and the magazine.

8. A driving tool comprising:

a housing having a handle and a pressure chamber;

a pneumatic linear motor housed in the housing and having an output member, the pneumatic linear motor being in fluid communication with the pressure chamber;

a driver blade disposed in the housing and coupled to the output member for movement therewith along a driver axis;

a magazine coupled to the housing, the magazine being configured to hold a plurality of fasteners and to sequentially feed the fasteners into a position where they can be engaged by the driver blade to be driven into a workpiece; and a gas feed system comprising:

a directional valve having a first inlet, a second inlet and an outlet, the outlet being coupled in fluid communication with the pressure chamber, the first inlet being configured to be coupled in fluid communication to a first source of compressed gas;

a tank coupled to the housing and coupled in fluid communication with the second inlet, the tank being configured for use as a second source of compressed gas;

a shut-off valve disposed between the second inlet and the directional valve; and a regulator disposed in fluid communication between the shut-off valve and the directional valve.

9. The driving tool of claim 8, wherein the directional valve is configured to automatically select between the first and second flow paths based on a set of pre-defined criteria.

10. The driving tool of claim 9, wherein the set of pre-defined criteria comprises a pressure differential.

11. The driving tool of claim 8, wherein the directional valve is manually operated.

12. The driving tool of claim 8, further comprising a clamp that is selectively operable to fix the tank to the housing, the magazine or both the housing and the magazine.

13. A method for operating a driving tool, the driving tool having a housing, a pneumatic linear motor, a driver blade and a gas feed system, the housing having a pressure chamber, the pneumatic linear motor being housed in the housing and being coupled in fluid communication with the pressure chamber, the pneumatic linear motor having an output member to which the driver blade is coupled for movement therewith along a driver axis, the gas feed system comprising a directional valve, a pressure limiting device, a shut-off valve and a regulator, the directional valve having a first inlet, a second inlet and an outlet, the outlet being coupled in fluid communication with the pressure chamber, the method comprising:

coupling the first inlet to a first source of compressed gas;

coupling a gas tank to the second inlet such that the pressure limiting device is disposed between the regulator and the gas tank,. the gas tank being a second source of compressed gas; and securing the gas tank to the housing;

operating the directional valve in a first condition to direct compressed gas from the first source of compressed gas to the pressure chamber;

operating the directional valve in a second condition to direct compressed gas from the gas tank to the pressure chamber; and adjusting the regulator to change the pressure of the gas entering the pressure chamber when the directional valve is in the second condition.

* * * * *